US008841051B2

(12) United States Patent
Hirano et al.

(10) Patent No.: US 8,841,051 B2
(45) Date of Patent: Sep. 23, 2014

(54) FULL COLOR IMAGE FORMING METHOD USING TWO CYAN TONERS

(75) Inventors: Shiro Hirano, Tokyo (JP); Naohiro Hirose, Tokyo (JP); Kaori Soeda, Tokyo (JP); Miyuki Murakami, Tokyo (JP); Youhei Ohno, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 561 days.

(21) Appl. No.: 12/919,170

(22) PCT Filed: Jul. 13, 2009

(86) PCT No.: PCT/JP2009/062667

§ 371 (c)(1),
(2), (4) Date: Aug. 24, 2010

(87) PCT Pub. No.: WO2010/007963

PCT Pub. Date: Jan. 21, 2010

(65) Prior Publication Data

US 2011/0008071 A1 Jan. 13, 2011

(30) Foreign Application Priority Data

Jul. 14, 2008 (JP) ..... 2008-182521

(51) Int. Cl.
*G03G 15/01* (2006.01)
*G03G 9/08* (2006.01)
*G03G 9/09* (2006.01)

(52) U.S. Cl.
CPC ..... *G03G 15/0178* (2013.01); *G03G 9/0821* (2013.01); *G03G 9/09* (2013.01); *G03G 9/0926* (2013.01); *G03G 9/0918* (2013.01)
USPC ..... 430/45.5; 399/223

(58) Field of Classification Search
USPC ..... 399/223; 430/45.5
See application file for complete search history.

(56) References Cited

U.S. PATENT DOCUMENTS

| | | | | |
|---|---|---|---|---|
| 7,105,045 | B2 * | 9/2006 | Kabalnov et al. | 106/31.49 |
| 8,084,175 | B2 * | 12/2011 | Hirose et al. | 430/107.1 |
| 8,092,964 | B2 * | 1/2012 | Hayashi et al. | 430/108.21 |
| 2004/0209178 | A1 * | 10/2004 | Itakura et al. | 430/45 |
| 2008/0113284 | A1 * | 5/2008 | Hayashi et al. | 430/45.5 |
| 2010/0021194 | A1 * | 1/2010 | Toyohara et al. | 399/69 |

FOREIGN PATENT DOCUMENTS

| | | | | |
|---|---|---|---|---|
| JP | H08-328341 | A | | 12/1996 |
| JP | H11-002929 | A | | 1/1999 |
| JP | H11-212327 | A | | 8/1999 |
| JP | 11338190 | A | * | 12/1999 |
| JP | H11-338190 | A | | 12/1999 |
| JP | 2000-029243 | A | | 1/2000 |
| JP | 2003341111 | A | * | 12/2003 |
| JP | 2004-070208 | A | | 3/2004 |
| JP | 2004070208 | A | * | 3/2004 |
| JP | 2004-133381 | A | | 4/2004 |
| JP | 2004-252162 | A | | 9/2004 |
| JP | 2004-295079 | A | | 10/2004 |
| JP | 2005-055482 | A | | 3/2005 |
| JP | 2005-173576 | A | | 6/2005 |
| JP | 2007-070209 | A | | 3/2007 |
| JP | 2007108466 | A | * | 4/2007 |
| JP | 2009075520 | A | * | 4/2009 |

OTHER PUBLICATIONS

English language machine translation of JP 2009-075520 (Apr. 2009).*

* cited by examiner

*Primary Examiner* — Christopher Rodee
(74) *Attorney, Agent, or Firm* — Lucas & Mercanti, LLP

(57) ABSTRACT

Provided is a full color image forming method wherein high color reproducibility especially on a blue system and a green system can be obtained and an excellent gradation property can be obtained in a full color image to be obtained. The full color image forming method for forming a full color image by using at least yellow toner, magenta toner, and two kinds of cyan toners (1, 2) is characterized in that a toner image formed by the cyan toner (1) alone has the value of the maximum color saturation (C*) of not less than 50 and the value of lightness (L*) in a color space represented by an L*a*b* colorimetric system of not less than 30 and not more than 52, and that a toner image formed by the cyan toner (2) alone has the value of the maximum color saturation (C*) of not less than 50 and the value of the lightness (L*) in the color space represented by the L*a*b* colorimetric system of not less than 58 and not more than 75.

4 Claims, 1 Drawing Sheet

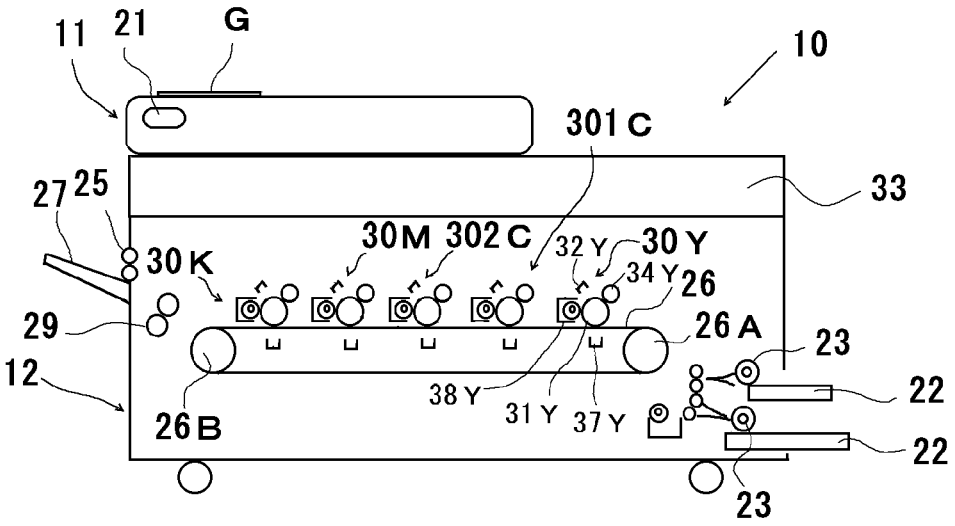
11
21
G
10
301 C
33
27
25
30 K
30M
302 C
32 Y
30 Y
34 Y
26
29
26 A
23
12
22
38 Y
31 Y
37 Y
26 B
22
23

FULL COLOR IMAGE FORMING METHOD USING TWO CYAN TONERS

This is a 371 of PCT/JP2009/062667 filed Jul. 13, 2009 which in turn claimed the priority of Japanese Patent Application No. 2008-18251 filed Jul. 14, 2008, both applications are incorporated by reference herein.

TECHNICAL FIELD

The present invention relates to an electrophotographic full color image forming method using an electrostatic image developing toner (hereinafter, it is also called simply as a toner).

BACKGROUND

In recent years, by employing an electrophotographic full color image forming method using an electrostatic image developing toner, it has become possible to achieve a full color image (a full color print) formation, in addition to a conventional monochrome image (a monochrome print) formation mainly used for producing a document.

In such electrophotographic method for forming an image using a toner, a full color image having a desired color is formed by superimposing plural toner images each made of a yellow toner, a magenta toner, or a cyan toner (for example, refer to Patent document 1).

In particular, when a full color image used for a catalog, an advertisement, or a poster is formed, it is required that an original picture image should be reproduced faithfully. In connection with it, it is required to realize a high degree of gradation or to raise more colorfulness of the color of a picture image, and further it is required to extend the color reproduction range of a picture image.

However, it has become recognized that only three kinds of color toners of yellow, magenta and cyan are insufficient to realize sufficient color reproduction when they are used as electrostatic image developing toners for forming a full color image. Then, there has been proposed a method of performing image formation in which a light color toner is used for the highlight image portion having a high lightness and a deep color toner is used for a solid image of the low lightness image portion, in addition to these three color toners (for example, refer to Patent documents 2 to 7).

For example, in Patent document 2, there was proposed a image forming method in which a light cyan toner having a high lightness and a deep cyan toner having a low lightness are used as electrostatic image toners each specified the hue of the red to green direction and the hue of the yellow to blue direction in addition to a yellow toner and a magenta toner However, the full color image formed using a light color toner and a deep color toner was unable to produce a sufficient level of color reproduction range which was required. The reason was as follows: since the used light cyan toner was produced by reducing the amount of the pigment which constituted a colorant to exhibit a high lightness, the color saturation of the light color toner was lowered and it was difficult to realize a sufficient color reproduction.

PRIOR ART DOCUMENTS

Patent Documents

Patent document 1: Japanese Patent Application Publication (JP-A) No. 8-328341

Patent document 2: JP-A No. 2005-173576

Patent document 3: JP-A No. 11-212327

Patent document 4: JP-A No. 2004-70208

Patent document 5: JP-A No. 2004-70209

Patent document 6: JP-A No. 2004-133381

Patent document 7: JP-A No. 2004-295079

SUMMARY OF THE INVENTION

Problems to be Solved by the Invention

The present invention was made based on the above situation. That is, an object of the present invention is to provide a full color image forming method which produces a full color image exhibiting a high color reproduction property of bluish colors and greenish colors as well as exhibiting an outstanding gradation property.

Means to Solve the Problems

The present invention has been attained by taking the compositions described in the following.

A method for forming a full color image using at least a yellow toner, a magenta toner, a cyan toner (1) and a cyan toner (2), wherein a toner image formed by using solely the cyan toner (1) exhibits: a maximum chroma C* of 50 or more; and a lightness L* of 30 to 52 in a color space represented by L*a*b* colorimetric system, and a toner image formed by using solely the cyan toner (2) exhibits: a maximum chroma C* of 50 or more; and a lightness L* of 58 to 75 in a color space represented by L*a*b* colorimetric system.

The above-described composition can be describes as follows.

A method for forming a full color image using at least a yellow toner, a magenta toner, a low lightness cyan toner satisfying Requirement (1) and a high lightness cyan toner satisfying Requirement (2).

Requirement (1): a toner image formed by using solely the low lightness cyan toner exhibits: a maximum chroma C* of 50 or more; and a lightness L* of 30 to 52 in a color space represented by L*a*b*.

Requirement (2): a toner image formed by using solely the high lightness cyan toner exhibits: a maximum chroma C* of 50 or more; and a lightness L* of 58 to 75 in a color space represented by L*a*b*.

In the method for forming a full color image according to the present invention, it is preferable that the following requirements are satisfied:

a toner image formed by using solely the yellow toner exhibiting: a maximum chroma C* of 85 or more; and a lightness L* of 70 to 90 in a color space represented by L*a*b* colorimetric system, and a toner image formed by using solely the magenta toner exhibiting: a maximum chroma C* of 70 or more; and a lightness L* of 20 to 55 in a color space represented by L*a*b* colorimetric system.

This means that it is preferable to use the yellow toner and the magenta toner each satisfying the following requirement: a toner image formed by using solely the yellow toner exhibits a maximum chroma C*(y) of 85 or more and a lightness L*(y) of 70 to 90 in a color space represented by L*a*b*; and a toner image formed by using solely the magenta toner exhibits a maximum chroma C*(m) of 70 or more; and a lightness L*(m) of 20 to 55 in a color space represented by L*a*b*.

In the method for forming a full color image according to the present invention, it is preferable that the yellow toner, the magenta toner, the low lightness cyan toner (the cyan toner (1)) and the high lightness cyan toner (the cyan toner (2)) each exhibit a softening point of 75 to 115° C., and it is preferable that the difference of the highest softening point and the lowest softening point of these four toners is in the range of less than 4° C.

Effects of the Invention

In the method for forming a full color image according to the present invention, there are used two kinds of cyan toners each having a different lightness. One of these cyan toners exhibits a lightness L* of 30 to 52, and the other cyan toner exhibits a lightness L* of 58 to 75. At the same time, both cyan toners exhibit a maximum chroma C* of 50 or more. It has been achieved to expand the color reproduction without deteriorating the colorfulness of the picture image by using these two kinds of cyan toners each having a different lightness. As a result, the obtained full color image shows a high color reproduction quality and the outstanding gradation. Especially, a good result was obtained in the color image formation of bluish colors and greenish colors.

BRIEF DESCRIPTION OF THE DRAWING

FIG. 1 is a schematic view showing an example of a tandem type full-color image forming apparatus used for a full color image forming method of the present invention.

EMBODIMENTS TO CARRY OUT THE INVENTION

Hereafter, the present invention will be described in detail.

The full color image forming method concerning the present invention forms a full color image at least through the following manufacturing processes.

Namely, a full color image is formed via at least the following processes (a) to (c):

(a) a development process which forms a toner image by developing an electrostatic latent image formed on an electrostatic latent image carrier by employing a developer (b) a transfer process which transfers the toner image formed on the electrostatic latent image carrier onto an image support, and (C) a fixing process which fixes the toner image transferred onto the image support.

In the above-describe full color image forming method, there are used at lease a yellow toner, a magenta toner and two kinds of cyan toners each having a different lightness. The toner images each respectively formed by using only one of these two kinds of cyan toners exhibit different lightness, however, the maximum chroma C* of these cyan toner images are controlled to be more than the predetermined range. When the two kinds of cyan toners each having a different lightness are designated as a cyan toner (1) and a cyan toner (2), toner images each respectively formed with each cyan toner satisfy the following requirements. Here, although it is described as "the two kinds of cyan toners each having a different lightness", this indicates that the toner images each respectively formed by using only one of these two kinds of cyan toners exhibit different lightness. From this viewpoint, a cyan toner (1) which forms a cyan toner image exhibiting relatively low lightness is also called as "a low lightness cyan toner, and a cyan toner (2) which forms a cyan toner image exhibiting relatively high lightness is also called as "a high lightness cyan toner.

Requirements (a) Toner image formed by using solely a cyan toner (1):

a maximum chroma C* being 50 or more; and a lightness L* in a color space represented by L*a*b* colorimetric system being 30 to 52.

a toner image formed by using solely the second cyan (b) Toner image formed by using solely a cyan toner (2): a maximum chroma C* being 50 or more; and a lightness L* in a color space represented by L*a*b* colorimetric system being 58 to 75.

"The maximum chroma" in the present invention is defined as follows. When image formation is done using a toner particle containing a sufficient amount of colorant (usually, content of colorant is 8 to 10 weight %), chroma of the toner image will increase almost proportionally with the increase of a toner adhesion amount on the image support. However, when the toner adhesion amount exceeds a certain level, chroma does not increase any more even though the adhesion amount is increased, to such an extent it becomes sluggish, and is eventually to be lowered. When the toner adhesion amount is increased, chroma at a turning point from the increase to the decrease is defined as a maximum chroma in this case. On the other hand, when the chroma is kept proportional to toner adhesion amount, the chroma of the toner image achieved by the maximum adhesion amount of toner on the image support, which can be set by the image forming apparatus, is defined as a maximum chroma in this case.

It can be used "ECI2002 chart (Random Layout)" recommended by ECI (European Color Initiative) as an output image for measurements. As an image support used for measurements of chroma and lightness, it can be used a material having a weight of 128 g/m$^2$ and a lightness of 93. For example, "POD GLOSS COAT" (made of Oji Paper Co. Ltd.) can be cited as a specific image support. Moreover, the fixing condition of the toner image is the standard fixing condition of the image forming apparatus which adopts the present invention. The measurement of glossiness of the toner image is carried out at measurement angle of 75 degree with Gloss Meter (manufactured by Murakami Color Research Laboratory Co., Ltd.). The measurement is done on a portion of the image having a glossiness of 10 or more.

Thus, the maximum chroma is defined by connection with toner adhesion amount. And chromas including the maximum chroma are computed by the following Equation (1).

"Chroma" is a value which shows the degree of the colorfulness of color, and it indicates the value calculated according to the following Equation (1) from the values of a* and b* measured based on L*a*b* colorimetric system [CIE (Commission Internationale de l'Eclairage=International Commission on Illumination) 1976 (L*a*b*) color space].

"L*a*b* colorimetric system" described herein is one of the means employed to represent a color by numeric values. L* is a coordinate value in the z-axis direction of L*a*b* system of color representation chromaticity diagram, it expresses lightness. "a*" is a value of the a* coordinate in L*a*b* system of color representation chromaticity diagram, and "b*" is a value of the b* coordinate in L*a*b* system of color representation chromaticity diagram. Hue and chroma of a color are represented by both a* and b*.

"Hue" refers to a color such as red, yellow, green, blue, violet or the like. Specifically, in the x-axis-y-axis plane of L*a*b* system of color representation chromaticity diagram, the plus (+) direction of the x-axis represented by a* on the x-axis-y-axis plane is a red direction, and the minus (−) direction of the x-axis is a green direction. The plus (+) direction of y-axis represented by b* is a yellow direction, and the minus (−) direction of y-axis is a blue direction.

"Chroma" refers to a color brightness degree defined by the following Equation (1).

$$\text{Chroma } C^* = [(a^*)^2 + (b^*)^2]^{0.5} \quad \text{Equation (1)}$$

As is shown in Equation (1), Chroma C* is a distance of a certain coordinate point (a*, b*) from origin O on the x-axis-y-axis plane as is shown by the aforesaid Equation (1). The values of a* and b* to determine chroma C* based on the aforesaid Equation (1) can be measured by a spectrophotometer "GRETAG MACBETH SPECTROLINO" (produced by Gretag Macbeth Co Ltd.). The measurement using the aforesaid spectrophotometer is carried out with the following conditions: a D65 light source as a light source, a reflection measuring aperture diameter of 4 mm, 10 nm intervals in the wavelength range of 380 to 730 nm to be measured, a viewing angle (observer) of 2°, and an exclusive white tile for adjustment of the base line.

When the toner images to be measured are formed respectively by a first cyan toner and a second cyan toner, the maximum chroma C* is one measured at a hue angle h of 195°.

Herein, "hue angle h" means an angle made between a half line connecting a certain coordinate point (a, b) to origin O on the x-axis-y-axis plane showing the relationship of hue and chroma when lightness takes a certain value, and a line extending in the plus (+) direction (red direction) of x-axis in the counter-clockwise direction from the plus (+) direction (red direction) of x-axis, and is calculated by the following Equation (2).

$$\text{Hue angle } h = \tan^{-1}(b^*/a^*) \quad \text{Equation (2)}$$

The aforesaid lightness L* indicates a relative luminosity of a color. The value of lightness L* can be measured in the same manner as measurement of the values a* and b* by a spectrophotometer "GRETAG MACBETH SPECTROLINO" (produced by Gretag Macbeth Co. Ltd.). The measurement of lightness L* using the aforesaid spectrophotometer also carried out with the following conditions: a D65 light source as a light source, a reflection measuring aperture diameter of 4 mm, 10 nm intervals in the wavelength range of 380 to 730 nm to be measured, a viewing angle (observer) of 2°, and an exclusive white tile for adjustment of the base line.

When the toner images to be measured are formed respectively by the aforesaid cyan toner (1) and the aforesaid cyan toner (2), the lightness L* is one measured at a hue angle h of 195 degree.

In the present invention, when the toner image is formed by using solely the aforesaid cyan toner (1), the maximum chroma C* of the toner image is 50 or more; and a lightness L* is 30 to 52. The lightness L* is specifically preferable to be 48 to 52.

Further, when the toner image is formed by using solely the aforesaid cyan toner (2), the maximum chroma C* of the toner image is 50 or more; and a lightness L* is 58 to 75. The lightness L* is specifically preferable to be 64 to 74.

Further, the difference of the lightness ΔL* between the lightness of the toner image formed by using solely the cyan toner (1) and the lightness of the toner image formed by using solely the cyan toner (2) is preferably to be 6 or more, and it is more preferably in the range of 8 to 15.

In the method for forming a full color image according to the present invention, it is preferable that a toner image formed by using solely the yellow toner and a toner image formed by using solely the magenta toner respectively satisfy the following requirements.

The toner image formed by using solely the yellow toner exhibiting: a maximum chroma C* of 85 or more; and a lightness L* in a color space represented by L*a*b* colorimetric system of 70 to 90.

The toner image formed by using solely the magenta toner exhibiting: a maximum chroma C* of 70 or more; and a lightness L* in a color space represented by L*a*b* colorimetric system of 20 to 55.

Here, the values of a* and b* to obtain the maximum chroma C* and the lightness L* of the toner image formed by using solely the yellow toner are measured at a hue angle h of 75 degree. And, the values of a* and b* to obtain the maximum chroma C* and the lightness L* of the toner image formed by using solely the magenta toner are measured at a hue angle h of 315 degree.

Thus, when the toner image formed by using solely the yellow toner satisfies the above-mentioned requirements, the light green toner image produced by combination of the yellow toner and the cyan toner (2) having a high lightness will acquire an excellent graininess without giving a feeling of roughness.

The reason is considered as follows. Generally, the lightness of the toner image formed solely with a yellow toner will become higher than the lightness of the toner image formed solely with cyan toner. Then, the toner image of the light green derived from combination of a yellow toner and a cyan toner is formed by placing the dots of the cyan toner on top of the yellow toner image which is underlaid.

Since the difference of the lightness of the yellow toner image and the lightness of the toner image formed with the cyan toner (2) is made small in the present invention, in the light green toner image, the dots of the cyan toner can be unnoticed, and, as a result, it is thought that an excellent graininess came to be acquired.

Further, when the toner image formed by using solely the magenta toner satisfies the above-mentioned requirements, the dark blue toner image produced by combination of the magenta toner and the cyan toner (1) having a low lightness will acquire an excellent graininess without giving a feeling of roughness.

The reason is considered as follows. Generally, the lightness of the toner image formed solely with a magenta toner will become lower than the lightness of the toner image formed solely with cyan toner. Then, the toner image of the dark blue derived from combination of a cyan toner and a magenta toner is formed by placing the dots of the magenta toner on top of the cyan toner image which is underlaid.

Since the difference of the lightness of the magenta toner image and the lightness of the toner image formed with the cyan toner (1) is made small in the present invention, in the dark blue toner image, the dots of the magenta toner can be unnoticed, and, as a result, it is thought that an excellent graininess came to be acquired.

In the present invention, when the toner image is formed by using solely the yellow toner, it is preferable that the maximum chroma C* of the toner image is 85 or more and that a lightness L* is 70 to 90. From the viewpoint of improving the color rendering property of the toner image having of a green color which is one of second colors produced by the yellow toner, the lightness L* of the yellow toner is more preferably from 80 to 90, and it is still more preferably from 85 to 90.

Moreover, in the present invention, when the toner image is formed by using solely the magenta toner, it is preferable that the maximum chroma C* of the toner image is 70 or more and that a lightness L* is 20 to 55. From the viewpoint of improving the color rendering property of the toner image having of a reddish color or a bluish color which is one of second colors produced by the magenta toner, the maximum chroma C* of the magenta toner is more preferably from 70 to 100. When the maximum chroma C* is from 70 to 100, the lightness L* is more preferably from 35 to 51, and it is still more preferably from 40 to 49 from the viewpoint of improving the color rendering property of the toner image having of a bluish color, a purplish color or a reddish color which is one of second colors produced by the magenta toner.

The yellow toner, the magenta toner and the cyan toner (1) and the cyan toner (2) according to the present invention are preferable to have a softening point (Tsp) of 75° C. to 115° C., and more preferable to have Tsp of 80° C. to 110° C.

By making the softening point the toner to the above-mentioned range, the elastic modulus of the toner can be maintained so that an offsetting phenomenon may not be generated with the heat at the time of fixation, and at the same time, the formed toner image can be made thin. Thus, when the toner image is made thin, a sufficient chroma will be obtained because more reflected light can be passed through the toner image.

Furthermore, it is preferable that the difference of the highest softening point and the lowest softening point is within the range of less than 4° C. among the softening points of the four kinds of toners: the yellow toner, the magenta toner, the cyan toner (1), and the cyan toner (2). By making the difference of the softening point of the four toners into above-mentioned range, it can be reduced the generation of the uneven gloss resulting from superimposition of colors in the imaging range which is formed by superimposing each toner. Therefore, it can be realized to produce a high-class feeling in the picture image (printing) by improving the homogeneity of gloss even in an imaging portion like the shadow part of a photographic image.

The softening point of the toners used in the full color image forming method concerning the present invention is controllable by the following operations, for example:

(1) To adjust the type and the composition ratio of a polymerizable monomer which are used to obtain the resin;
(2) In the manufacturing process of toner, to control the molecular weight of the resin by adjusting the type and the amount of the chain transfer agent used during the process of producing the resin; and
(3) To adjust the type and the amount of the composing materials such as a releasing agent and others.

The softening point of a toner may be measured by using, for example, Flow Tester CFT-500 (produced by Shimazu Seisakusho Ca, Ltd.). The processes are as follows. A sample is molded to have a 10 mm high column. This columnar sample is compressed by a plunger at a load of $1.96\times10^6$ Pa with heating at a temperature rising rate of 6° C./min and extruded from a nozzle having a diameter of 1 mm and a length of 1 mm, whereby, a softening flow curve representing the relationship between an amount of drop from the plunger and the temperature is drawn. The temperature corresponding to a drop of 5 mm is defined as the softening point.

The toner used for the full color image forming method concerning the present invention will be further described. The toner used for the full color image forming method concerning the present invention is composed of at least particles containing a resin and a colorant (hereafter, these particles are referred to colored particles). The cyan toner (1), the cyan toner (2), the yellow toner and the magenta toner used in the present invention will become toners enabling to produce an image satisfying the above-described requirements by adjusting the kinds, the composition and the amount of the colorants used.

Examples of a colorant usable in the cyan toner (1) which produces a low lightness include: a copper phthalocyanine compound such as C. I. Pigment Blue 15:1 to 15:3, or C. I. Pigment Blue 78, a zinc phthalocyanine compound, an aluminium phthalocyanine compound. They can be used solely. Furthermore, it is also possible to use the above-mentioned colorants by combining other colorants, such as a colorant usable in the cyan toner (2) which will be described, with a proper weight ratio.

As a colorant usable in the cyan toner (2) which produces a high lightness, a compound represented by the following Formula (I), the following Chemical Formula (1), and the following Chemical Formula (2) can be used conveniently independently, for example. Furthermore, it is also possible to use the above-mentioned colorants by combining other colorants, such as a colorant usable in the aforesaid cyan toner (1), with a proper weight ratio.

Formula (I)

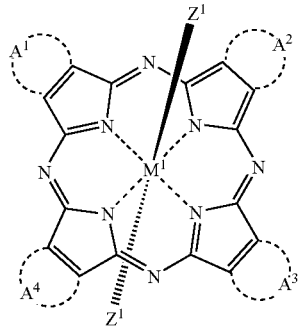

Chemical Formula (1)

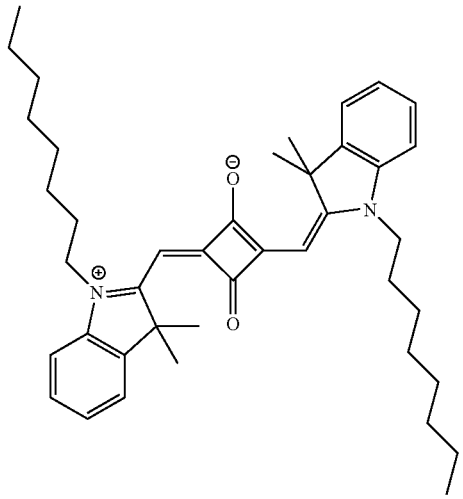

Chemical Formula (2)

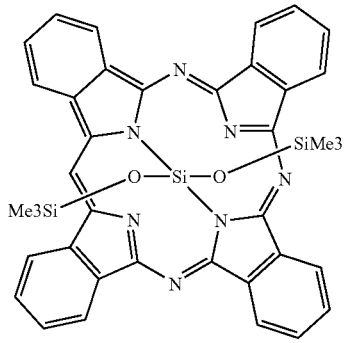

In Formula (I), $M^1$ represents a silicon atom, a germanium atom, or a tin atom; $Z^1$s each independently represents a hydroxyl group, an aryloxy group of 6 to 18 carbon atoms; an alkoxy group of 1 to 22 carbon atoms; or a group represented by the following Formula (II); and $A^1$ to $A^4$ each independently represents a group of atoms which forms a benzene ring.

Formula (II)

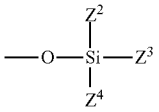

In Formula (II), $Z^2$ to $Z^4$ each independently represents an alkyl group of 1 to 22 carbon atoms; an aryloxy group of 6 to 18 carbon atoms; or an alkoxy group of 1 to 22 carbon atoms.

As a colorant usable in the yellow toner, it is preferable to selectively use a yellow colorant which satisfies the requirement of exhibiting the maximum chroma C* of 85 or more and the lightness L* of 70 to 90 when an image is formed solely with the yellow toner. And it is still more preferable to selectively use a yellow colorant so that the lightness L* becomes 80 to 90 when the maximum chroma C* is 85 or more from the viewpoint of raising the color rendering property of the toner image of a green color which is one of the secondary colors formed using the yellow toner.

Specifically, the colorants in the yellow toner are preferably selected by combining at least a yellow colorant which constitutes the following group X and a yellow colorant which constitutes the following group Y. The weight ratio of the yellow colorant contained in the group X (hereafter, it is also called as a group X colorant) to the yellow colorant contained in the group Y (hereafter, it is also called as a group Y colorant), group X colorant: group Y colorant, is adjusted to be between 65:35 and 95:5.

Group X

Group X is composed of C. I. Pigment Yellow 3, C. I. Pigment Yellow 35, C. I. Pigment Yellow 65, C. I. Pigment Yellow 74, C. I. Pigment Yellow 98, and C. I. Pigment Yellow 111.

Group Y

Group Y is composed of C. I. Pigment Yellow 9, C. I. Pigment Yellow 36, C. I. Pigment Yellow 83, C. I. Pigment Yellow 110, C. I. Pigment Yellow 139, C. I. Pigment Yellow 181, and C. I. Pigment Yellow 153.

As a colorant for the magenta toner, it is preferable to selectively use a magenta colorant which satisfies the requirement of exhibiting the maximum chroma C* of 70 or more and the lightness L* of 20 to 55 when an image is formed solely with the magenta toner.

And it is more preferable to selectively use a magenta colorant so that the maximum chroma C* becomes 70 to 100 from the viewpoint of raising the color rendering property of the toner image of a reddish color or a bluish color which is one of the secondary colors formed using the magenta toner. And it is still more preferable to selectively use a magenta colorant so that the lightness L* becomes 35 to 51 when the maximum chroma C* is 70 to 100.

Specifically, the colorants in the magenta toner are used by combining the following pigments, dyes, and complex compounds (hereafter they are also called as "specific magenta colorants"), that is, by mixing the dispersion of each colorant.

Specific examples of the pigment are: C. I. Pigment Red 2, C. I. Pigment Red 3, C. I. Pigment Red 6, C. I. Pigment Red 7, C. I. Pigment Red 9, C. I. Pigment Red 15, C. I. Pigment Red 16, C. I. Pigment Red 48:1, C. I. Pigment Red 48:3, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, C. I. Pigment Red 208, C. I. Pigment Red 209 and C. I. Pigment Red 222.

Specific examples of the dye are: C. I. Solvent Red 3, C. I. Solvent Red 14, C. I. Solvent Red 17, C. I. Solvent Red 18, C. I. Solvent Red 22, C. I. Solvent Red 23, C. I. Solvent Red 49, C. I. Solvent Red 51, C. I. Solvent Red 53, C. I. Solvent Red 87, C. I. Solvent Red 127, C. I. Solvent Red 128, C. I. Solvent Red 131, C. I. Solvent Red 145, C. I. Solvent Red 146, C. I. Solvent Red 149, C. I. Solvent Red 150, C. I. Solvent Red 151, C. I. Solvent Red 152, C. I. Solvent Red 153, C. I. Solvent Red 154, C. I. Solvent Red 155, C. I. Solvent Red 156, C. I. Solvent Red 157, C. I. Solvent Red 158, and C. I. Solvent Red 176 and C. I. Solvent Red 179.

Moreover, as preferable examples of the complex compound, the compounds represented by the following Chemical Formula (3) to Chemical Formula (6) can be cited.

Chemical Formula (3)

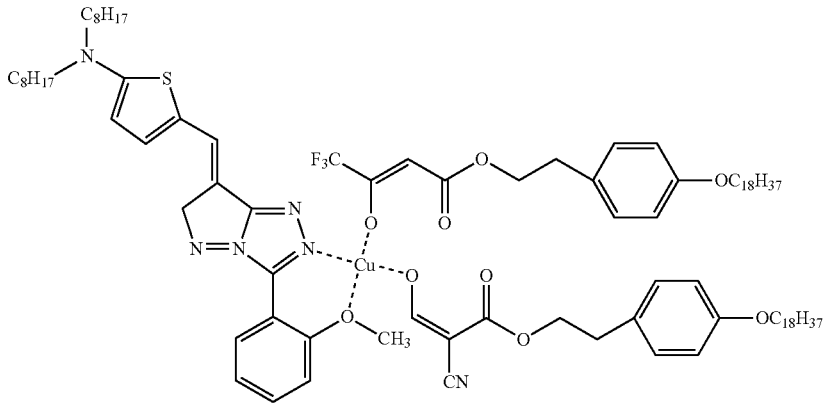

-continued

Chemical Formula (4)

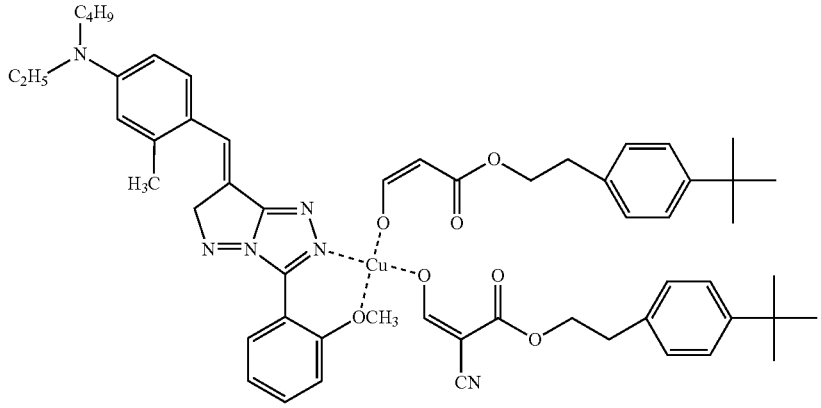

Chemical Formula (5)

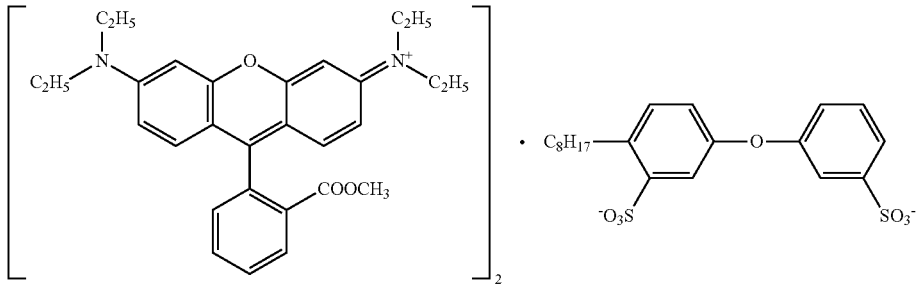

Chemical Formula (6)

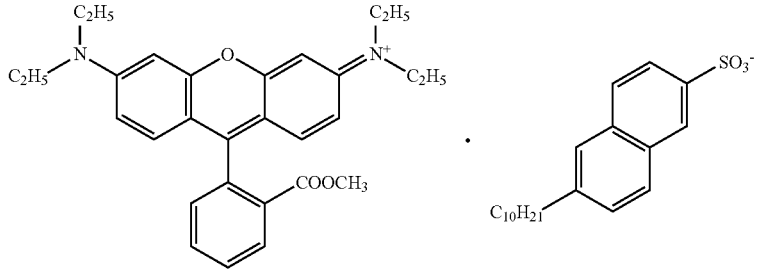

The added amount of these colorants is from 1 to 30 weight % based on the total weight of the toner, and it is more preferably from 2 to 20 weight %.

Next, a binder resin constituting the toner of the present invention will be described. Binder resins usable for the toner of the present invention are not specifically limited, but the used binder resins are typically polymers formed by polymerization of polymerizable monomers. The binder resin is composed of a polymer obtained by polymerization of at least one polymerizable monomer. The polymer may be prepared by using one kind of monomer or it may be prepared by combining a plurality of monomers in combination.

As a representative example of a polymer which is used for this binder resin, it may be cited a vinyl polymer which is produced with a vinyl monomer.

Examples of a vinyl monomer to produce a vinyl polymer include: styrene or styrene derivative; a methacrylic acid ester derivative (for example, methyl methacrylate, ethyl methacrylate, n-butyl methacrylate, t-butyl methacrylate, n-octyl methacrylate, 2-ethylhexyl methacrylate, stearyl methacrylate, lauryl methacrylate, and phenyl methacrylate); and an acrylic acid ester derivative (for example, methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate).

There may also be used a polymerizable monomer having an ionic dissociative group of a functional group such as carboxyl group or a sulfo group in a side chain with a vinyl monomer to produce a vinyl polymer.

Example of the polymerizable monomer having an ionic dissociative group include as follows: monomers containing a carboxyl group (such as acrylic acid, methacrylic acid, maleic acid, itaconic acid, cinnamic acid and fumaric acid); and monomers containing a sulfonic acid group (such as styrenesulfonic acid and allylsulfosuccinic acid).

Further, a cross-linked resin can be obtained using polyfunctional vinyl compounds. Examples of such poly-functional vinyl compounds are divinylbenzene, ethylene glycol dimethacrylate and ethylene glycol diacrylate.

The electrostatic image developing toner used in the present invention may contain other component such as a leasing agent (for example, a wax) in addition to the aforesaid binder resin and colorant.

Examples of the leasing agent include: polyolefin wax such as polyethylene wax and polypropylene wax; long chain hydrocarbon wax such as paraffin wax and sasol wax; dialkyl ketone type wax such as distearyl ketone; carnauba wax, montan wax, trimethylolpropane tribehenate, pentaerythritol tetramyristate, pentaerythritol tetrastearate, pentaerythritol tetrabehenate, pentaerythritol diacetate dibehenate and glycerin tribehenate.

The melting point of a releasing agent used as a component of the toner in the present invention is usually from 40 to 125° C., preferably from 50 to 120° C., and more preferably from 60 to 90° C. By using a releasing agent having a melting point falling within the foregoing range, heat stability of the toners can be ensured. And stable toner image formation can be achieved without causing cold offsetting even when the image is fixed at a relatively low temperature. The content of the releasing agent in the toner is preferably in the range of 1 to 30 weight % bases on the total weight of the wax, and more preferably in the range of 5 to 20 weight %.

The electrostatic image developing toner used in the present invention preferably has a volume-based median particle diameter ($D50_V$) of 3.0 μm to 8.0 μm. By controlling the volume-based median particle diameter within the above-described range, it is possible to faithfully reproduce an image made of very fine dots such as, for example, 1,200 dpi (dpi: dots number per inch (2.54 cm)).

The volume based median diameter ($D50_V$) of the toner particles of the present invention can be measured and determined employing a size distribution measurement instrument, "COULTER MULTISIZER 3" (produced by Beckman-Coulter Co.) connected with a computer system (produced by Beckman-Coulter Co.) for data processing.

Measurement procedures are as follows. After allowing to soak 0.02 g of toner with 20 ml of a surface active agent solution (for example, a surface active agent solution, aimed at dispersing the toner, which is prepared by diluting with water a neutral detergent incorporating surface active agent components by a factor of 10), the mixture is subjected to microwave dispersion for one minute, whereby a toner dispersion is prepared. The resulting toner dispersion is injected into a beaker carrying ISOTON II (produced by Beckman-Coulter Co.) in the sample stand until reaching a measurement concentration of 8% by weight. By controlling the concentration to this range, a high reproducible measurement value can be obtained. And measurement is carried out while setting the count of the instrument at 25,000 and the employed aperture diameter of 50 μm. The measuring range of 1 to 30 μm is divided into 256 sections and a frequency value in each section is calculated. The volume based median diameter ($D50_V$) is a particle diameter at which 50% of a volume ratio is achieved when each volume is integrated from a large sized particle to a small sized particle.

The toner particles in the toner of the present invention preferably have a coefficient of variation (CV value) of a volume based particle diameter distribution in the range of 2% to 21%, and more preferably from 5% to 15%.

A coefficient of variation (CV value) of a volume based particle diameter distribution is a value indicating the degree of dispersion of the colored particles (toner particles) in the particle size distribution by the volume base. This value can be obtained from the following Equation (3). When the CV value is small, it means that the particle diameter distribution is narrow, hence, the size of the toner particles is uniform.

CV value(%) of a volume based particle diameter distribution=[(standard deviation in the volume based particle distribution)/(median diameter ($D50_V$) in the volume based particle distribution)]×100. Equation (3)

By controlling the CV value within the range as described above, the toner particles become uniform in volume size. As a result, it becomes possible to reproduce more delicate dots or line lines which are required in digital image formation with highly accuracy.

The producing method of a toner used in the present invention will be described. The electrostatic image developing toner used in the present invention can be produced with a conventionally known method.

Namely, it can be produced with a pulverization method containing the steps of kneading, pulverization, and classification. It can also be produced with a polymerization method (for example, emulsion polymerization method, a suspension polymerization method, and a polyester molecule elongation method) in which a polymerizable monomer is polymerized, at the same time, particle formation is done by controlling the shape and dimension of the particles.

The electrostatic image developing toner used in the present invention may contain only colored particles (indicating toner host particles without added an external additive), or it may be added an external additive containing inorganic particles or organic particles having a number average primary particle size of 4 to 800 nm, or a lubricant to the colored particles. By incorporating an external additive, fluid characteristics and charging property of the toner can be improved. In addition, improved cleaning property and transferring property of the toner are also achieved.

As inorganic particles, conventionally known compounds may be used. Preferable examples of inorganic particles employed are fine particles of silica, titanic, alumina and strontium titanate. These inorganic particles after subjected to hydrophobic treatment can also be used if required.

Specific example of silica fine particles includes commercially available products of R-805 R-976, R-974, R-972, R-812 and R-809 (made by Nippon Aerosil Co., Ltd.); HVK-2150 and H-200 (made by Hoechst Corporation); and TS-720 TS-530, TS-610, H-5, MS-5 (made by Cabot Corporation.)

Example of titania particles includes commercially available products of: T-805 and T-604 (made by Nippon Aerosil Co., Ltd.); MT-600S, MT-100B, MT-500BS, MT-600, MT-600SS and JA-1 (made by Teika Corporation); TA-300SI, TA-500, TAF-130, TAF-510 and TAF-510T (made by Fuji Titanium Industry Co. Ltd.).

Example of alumina particles includes commercially available products of: RFY-C and C-604 (made by Nippon Aerosil Co., Ltd.); and TTO-55 made by (Ishihara Sangyo Co. Ltd.).

Organic particles having a number average primary particle of 10 to 2,000 nm can be used as an external additive. Examples of the organic fine particles are: homopolymer or copolymer of a styrene resin, and a methyl methacrylate resin.

A lubricant made of a metal salt of higher fatty acid can be further added. Example of the metal salt of higher fatty acid includes: stearic acid salt of zinc, aluminum, copper, magnesium and calcium; and palmitic acid salt of zinc, copper, magnesium and calcium.

The external additives are preferably contained in an amount of 0.1 to 10.0 weight % based on the total weight of the toner.

The external additives can be added with a conventionally known mixer such as a turbular mixer, HENSCHEL MIXER, NAUTER MIXER or a V-shape mixer.

The electrostatic image developing toner of the present invention can be used as a magnetic or nonmagnetic one component developer or a two-component developer mixed with a carrier for forming an image.

When the toner is used as a two-component developer, it becomes possible to obtain a full color image having a good image quality at high speed with, for example, a tandem type image forming apparatus which will be mentioned later.

Moreover, by choosing suitably the composing materials of the toner for electrostatic image development, it can be possible to use for so-called low-temperature fixation in which the paper temperature at the time of fixation is about 100° C.

Examples of a carrier used in the two-component developer containing the electrostatic image developing toner of the present invention are: magnetic particles composed of commonly known materials such as metal like iron, ferrite or magnetite, or alloys of the foregoing metals and metal like aluminum or lead. Of these, ferrite particles are specifically preferable. A volume average particle size is preferably from 15 to 100 μm, and more preferably it is from 25 to 80 μm.

The toner of the present invention may be used in the embodiment of a nonmagnetic one component developer.

Then, an example of an image forming apparatus enabling to perform a full color image forming method of the present invention will be described. FIG. 1 is a schematic view showing an example of a tandem type full-color image forming apparatus used for a full color image forming method of the present invention.

Image forming apparatus 10 in FIG. 1 is composed of image reading section 11 and printer section 12. Image reading section 11 contains image reading unit 21 to read out photo-electrically the image information on manuscript G. Printer section 12 is provided with a plurality (5 units in FIG. 1) of image forming units 30Y, 301C, 302C, 30M, 30K, paper feed cassette 22, exposure apparatus 33 composed of a laser scanning apparatus and fixing apparatus 29, all of which are located along image support transport belt 26.

Image forming unit 30Y is a device which forms a toner image with a yellow toner. Image forming unit 30Y is provided with a latent image carrier composed of photoreceptor 31Y, and around this photoreceptor 31Y it has a composition in which a composition charging device 32Y, developing apparatus 34Y, transfer device 37Y and cleaning device 38Y are arranged.

Image forming units 301C, 302C, 30M and 30K each respectively form a toner image with a cyan toner (1), a cyan toner (2), a magenta toner and a black toner. Basically, each of them have the same composition as that of image forming unit 30Y.

Image support transport belt 26 is extended by a plurality of support rollers 26A and 26B, and it is supported so that circulation movement may become possible.

In image forming apparatus 10 in FIG. 1, each photoreceptor of image forming units 30Y, 301C, 302C, 30M and 30K are at first charged with a charging device. On the other hand, thorough exposure apparatus 33 there is emitted a laser light which is modulated in accordance with the image signals output from image reading section 11 to printer section 12. The aforesaid photoreceptors each are scanning exposed by this laser light. Thus, on each photoreceptor there are formed the electrostatic images (latent images) corresponding to a yellow color, a high lightness cyan color, a low lightness cyan color, a magenta color and a black color in response to the image information of manuscript G read with the image reading unit 21 which constitutes the image reading part 11.

The electrostatic image formed on each photoreceptor is developed by being provided with each toner of a yellow toner, a cyan toner (1), a cyan toner (1), a magenta toner and a black toner via each developing apparatus into a visible image to from a toner image.

When each color toner image is formed on each photoreceptor, synchronizing with this, an image support, such as a paper, accommodated in paper feed cassette 22 is fed sheet by sheet by paper feed roller 23 on the image support transport belt 26. And the image support is conveyed electrostatically adsorbed to the belt.

And on the conveyed image support, each color (yellow color, a cyan color of high lightness, a cyan color of low lightness, a magenta color and a black color) toner image of each photoreceptor is respectively transferred one by one by a transfer device, and a color toner image is formed.

The image support on which was formed a color toner image is conveyed to fixing apparatus 29 and fixing treatment is carried out. Thus, a full color image is formed on the image support. Then, held by paper discharge roller 25, the image support is discharged on paper discharge tray 27 located outside of the apparatus.

In image forming apparatus 10 in FIG. 1, a total of five image formation units are arranged so that a yellow toner image, a high lightness cyan toner image, a low lightness cyan toner image, a magenta toner image and a black toner image may be transferred by this order on an image support. Thus, since developing apparatuses are arranged so that the transfer may be made by order from the high lightness toner image to the low lightness toner image, even if color mixture occurs, it is difficult to produce an evil effect resulting from the color mixture.

Various kinds of image supports can be cited here as an image support. Examples of the image supports include: plain papers from a thin to thick paper, a fine quality paper, an art paper, a coated paper for printing press, commercially available Japanese paper and a post card, a plastic film for OHP and a cloth. However, the image recording supports for the present invention are not limited to them.

EXAMPLE

In the following, the embodiments of the present invention will now be specifically described referring to examples, but the present invention is not limited thereto.

Preparation of Low Lightness Cyan Toner 1 (Cyan Toner (1)

(1) Preparation of Cyan Colorant Particle Dispersion 1

An aqueous surfactant solution was prepared by dissolving 11.5 weight parts of sodium n-dodecylsulfate in 160 weight parts of ion-exchange water with stirring. To the aqueous surfactant solution was gradually added 5 weight parts of C. I. Pigment Blue 15:3 (colorant composed of copper phthalocyanine). Then, dispersion treatment was conducted employing a homogenizer "CLEARMIX W MOTION CLM-0.8" (manufactured by M Technique Co.) to prepare a colorant particle dispersion (hereafter, it is called as "low lightness cyan colorant particle dispersion (1)") containing colorant particles dispersed therein.

A volume-based median particle diameter of the prepared low lightness cyan colorant particle dispersion (1) was measured to be 126 nm.

The volume-based median diameter of colorant particles was determined via "MICROTRAC UPA 150" (manufactured by Honeywell Co.) under the following measurement conditions:

Sample refractive index: 1.59

Sample density: 1.05 g/cm$^3$ (converted in spherical particles)

Solvent refractive index: 1.33

Solvent viscosity: 0.797 at 30° C.

1.002 at 20° C.

Zero point adjustment: done by introducing ion-exchange water in a measurement cell.

(2) Preparation of Cyan Colored Particles 1

(A) Preparation of "Core Forming Resin Particles"

(a) 1$^{st}$ Step Polymerization (Formation of Core Particles)

In a 5 L reaction vessel fitted with a stirrer, a thermal sensor, a cooling pipe and a nitrogen introducing device was charged with an aqueous surfactant solution prepared by dissolving 4 weight parts of an anionic surfactant composed of sodium dodecylsulfate ($C_{10}H_{21}(OCH_2CH_2)_2SO_3Na$) in 3,040 weight parts of ion-exchange water. Then, the internal temperature of the system was increased to 80° C. while stirring at a stirring speed of 230 rpm under nitrogen flow. Into the above-described surfactant solution was added an initiator solution prepared by dissolving 10 weight parts of potassium persulfate (KPS) in 400 weight parts of ion-exchange water, and then heated up to 75° C. Then, there was added a polymerizable monomer solution containing 532 weight parts of styrene, 200 weight parts of n-butyl acrylate, 68 weight parts of methacrylic acid and 16.4 weight parts of n-octyl mercaptan into the reaction vessel spending one hour. After adding the foregoing monomer solution, this system was heated at 75° C. for 2 hours, and polymerization was conducted while stirring (the 1st step polymerization) to prepare a resin particle dispersion (1H) containing resin particles (1h).

The obtained resin particles (1h) had a weight average molecular weight of 16,500.

(b) 2nd Step Polymerization

Into a flask fitted with a stirring device was added a polymerizable monomer solution containing 101.1 weight parts of styrene, 62.2 weight parts of n-butyl acrylate, 12.3 weight parts of methacrylic acid and 1.75 weight parts of n-octyl mercaptan. Subsequently, 93.8 weight parts of paraffin wax "HNP-57" (produced by Nippon Seiro Co., Ltd.) were added into the foregoing polymerizable monomer solution and the mixture was dissolved by heating so that the inner temperature reached 80° C. to prepare a monomer solution.

On the other hand, an aqueous surfactant solution was prepared by dissolving 3 weight parts of the anionic surfactant used in the 1st step polymerization in 1,560 weight parts of ion-exchange water and it was introduced in the flask followed by heating so that the inner temperature reached 80° C. To the aqueous surfactant solution was added 32.8 weight parts (in terms of the solid content conversion) of a dispersion of the foregoing "resin particles (1h)" obtained in the 1st step polymerization. Further, the monomer solution containing paraffin wax was added. After the addition, the aforesaid monomer solution containing paraffin wax was mixed and dispersed for 8 hours by a mechanical dispersion apparatus "CLEAR MIX" (manufactured by M Technique Co.) equipped with a circulation pass to prepare an emulsified particle dispersion which contains emulsified particles (oil droplets) having a dispersion particle diameter of 340 nm.

Next, an initiator solution prepared by dissolving 6 weight parts of potassium persulfate in 200 weight parts of ion-exchange water was added into the foregoing dispersion, and this system was heated at 80° C. for 3 hours while stirring to conduct polymerization (the 2nd step polymerization), and to obtain a resin particle dispersion (1 HM) containing resin particles (1hm).

The obtained resin particles (1hm) had a weight average molecular weight of 23,000.

(3) 3rd Step Polymerization

To the resin particle dispersion (1 HM) obtained in the 2nd step polymerization was added an initiator solution prepared by dissolving 5.45 weight parts of potassium peroxide in 220 weight parts of ion-exchange water. To this mixture was dropped at 80° C. spending one hour a polymerizable monomer solution containing 293.8 weight parts of styrene, 154.1 weight parts of n-butyl acrylate and 7.08 weight parts of n-octyl mercaptan. After termination of dropping the foregoing monomer mixture solution, polymerization (the 3rd step polymerization) was conducted by heating while stirring for 2 hours, and subsequently, the system was cooled to 28° C. to prepare a resin particle dispersion containing "core forming resin particles (1)".

The core forming resin particles (1) thus prepared had a weight average molecular weight of 26,800 and exhibited a glass transition temperature (Tg) of 28.1° C.

A weight average particle diameter of the core forming resin particles (1) in the resin particle dispersion was measured to be 125 nm.

(B) Preparation of "Shell Forming Resin Particles"

"Shell forming resin particles (1)" were prepared in the same manner as the 1st step polymerization, except that the polymerizable monomer solution was replaced with the mixture containing 624 weight parts of styrene, 120 weight parts of n-butyl acrylate, 56 weight parts of methacrylic acid and 16.4 weight parts of n-octyl mercaptan.

The obtained shell forming resin particles (1) had a weight average molecular weight of 16,400 and exhibited a glass transition temperature (Tg) of 62.6° C.

A weight average particle diameter of the shell forming resin particles (1) in the resin particle dispersion was measured to be 95 nm.

(C) Preparation of Colored Particles (a) Formation of Core Particles

In a reaction vessel fitted with a stirrer, a thermal sensor, a cooling pipe and a nitrogen introducing device were charged with 420.7 weight parts of core forming resin particles (1), 900 weight parts of ion-exchange water and 200 weight parts of low lightness cyan colorant particle dispersion (1) and they were stirred. After the inner temperature of the vessel was adjusted to 30° C., of an aqueous sodium hydroxide solution having a density of 5 mol/litter was added into this solution to adjust the pH to 10.

Next, an aqueous solution prepared by dissolving 2 weight parts of magnesium chloride hexahydrate in 1,000 weight parts of ion-exchange water was added to the aforesaid mixture at 30° C. for 10 minutes while stirring. After standing for 3 minutes, elevation of temperature was started, and the temperature of this system was elevated to 65° C. spending 60 minutes. In such state, the particle diameter of associated particles was measured employing "Coulter counter TA-II" (produced by Beckman Coulter Co. Ltd), and when a volume-based median particle diameter $D_{50}$ reached 5.5 μm, the particle diameter increase was terminated via addition of an aqueous solution prepared by dissolving 40.2 weight parts of sodium chloride in 1,000 weight parts of ion-exchange water. Further, ripening was conducted at a liquid temperature of 70° C. for one hour by heating while stirring to continue the fusion, and then, "core containing liquid (1)" which contains "core particles (1)" was formed.

The circularity of the obtained "core particles (1)" was determined via "FPIA2100" (produced by SYSMEX Co., Ltd.), resulting in an average circularity of 0.912.

(B) Formation of Shell

After adjusting the temperature of the core containing liquid (1) to be 65° C., 96 weight parts of shell forming resin particles (1) were added. Subsequently, an aqueous solution prepared by dissolving 2 weight parts of magnesium chloride hexahydrate in 1,000 weight parts of ion-exchange water was further added spending 10 minutes. After the addition, the temperature was increased to 70° C., and stirring was continued spending one hour to fuse the shell forming resin particles (1) on the surface of "core particles (1)". After this, a ripening treatment was conducted at 75° C. for 20 minutes to form a shell layer.

Subsequently, the ripening treatment (shell formation) was stopped by adding 40.2 weight parts of sodium chloride. Then the system was cooled to 30° C. at a rate of 6° C./minute. The resulting particles were filtrated, and they were washed repeatedly with ion-exchanged water at 45° C. Thereafter, drying was conducted employing an air flow of 45° C. to obtain colored particles having a shell layer formed on the surface of the core particle (hereafter, they are also called as "low lightness cyan toner particles (CA-1)").

(3) External Additive Treating Process

To the obtained low lightness cyan toner particles (CA-1) was added an external additive composed of 0.6 weight parts of hexamethylsilazane-treated silica (an average primary particle diameter of 12 nm) and 0.8 weight parts of n-octylsilane-treated titanium oxide (an average primary particle diameter of 24 nm). By employing a HENSCHEL MIXER (produced by Mitsui Miike Mining Co., Ltd.), mixing was performed under conditions of a stirring blade peripheral rate of 35 m/second, a processing temperature of 35° C., and a processing period of 15 minutes. Thus, a low lightness cyan toner (hereafter, it is also called as "toner (CA-1)") was obtained.

In addition, the shape and the particle size of the obtained "low lightness cyan toner particles (CA-1)" were not changed by the addition of the external additive.

Preparation of Low Lightness Cyan Toners 2 to 6 (Cyan Toner (1)

Colorant particle dispersions were prepared in the same manner as preparation of the cyan colorant particle dispersion 1 in Preparation example 1 of Low lightness cyan toner, except that used colorants were changed as are listed in Table 1. Cyan colored particles were obtained in the same manner as preparation of the cyan colored particles 1, except that the obtained colorant particle dispersions were used. Further, by carrying out external additive treatment to the obtained cyan colored particles, Low lightness cyan toners were obtained (hereafter, they are called as "toners (CA-2) to (CA-6)").

Preparation of High Lightness Cyan Toners 1 to 6 (Cyan Toner (2))

Colorant particle dispersions were prepared in the same manner as preparation of the cyan colorant particle dispersion 1 in Preparation example 1 of Low lightness cyan toner, except that used colorants were changed as are listed in Table 1. Cyan colored particles were obtained in the same manner as preparation of the cyan colored particles 1, except that the obtained colored particle dispersions were used. Further, by carrying out external additive treatment to the obtained cyan colored particles, High lightness cyan toners were obtained (hereafter, they are called as "toners (CB-1) to (CB-6)).

Preparation of Comparative Cyan Toners 1 to 3

Comparative colorant particle dispersions were prepared in the same manner as preparation of the cyan colorant particle dispersion 1 in Preparation example 1 of Low lightness cyan toner, except that used colorants were changed as are listed in Table 1. Comparative cyan colored particles were obtained in the same manner as preparation of the cyan colored particles 1, except that the obtained comparative colored particle dispersions were used. Further, by carrying out external additive treatment to the obtained cyan colored particles, Comparative cyan toners were obtained (hereafter, they are called as "comparative toners (C-1) to (C-3)").

Preparation of Yellow Toner 1

(1) Preparation of Yellow Colorant Particle Dispersion 1

An aqueous surfactant solution was prepared by dissolving 11.5 weight parts of sodium n-dodecylsulfate in 160 weight parts of ion-exchange water with stirring. To the aqueous surfactant solution was gradually added 5 weight parts of colorant mixture composed of C. I. Pigment Yellow 65 and C. I. Pigment Yellow 36 (weight ratio of Pigment Yellow 65 to Pigment Yellow 36 was 95 to 5). Then, dispersion treatment was conducted employing a homogenizer "CLEARMIX W MOTION CLM-0.8" (manufactured by M Technique Co.) to prepare a colorant particle dispersion (hereafter, it is called as "yellow colorant particle dispersion (1)") containing colorant particles dispersed therein.

A volume-based median particle diameter of the prepared yellow colorant particle dispersion (1) was measured to be 126 nm.

(2) Preparation of Yellow Colored Particles 1

(A) Preparation of "Core Forming Resin Particles"

(a) $1^{st}$ Step Polymerization (Formation of Core Particles)

In a 5 L reaction vessel fitted with a stirrer, a thermal sensor, a cooling pipe and a nitrogen introducing device was charged with an aqueous surfactant solution prepared by dissolving 4 weight parts of an anionic surfactant composed of sodium dodecylsulfate ($C_{10}H_{21}(OCH_2CH_2)_2SO_3Na$) in 3,040 weight parts of ion-exchange water. Then, the internal temperature of the system was increased to 80° C. while stirring at a stirring speed of 230 rpm under nitrogen flow. Into the above-described surfactant solution was added an initiator solution prepared by dissolving 10 weight parts of potassium persulfate (KPS) in 400 weight parts of ion-exchange water, and then heated up to 75° C. Then, there was added a polymerizable monomer solution containing 532 weight parts of styrene, 200 weight parts of n-butyl acrylate, 68 weight parts of methacrylic acid and 16.4 weight parts of n-octyl mercaptan into the reaction vessel spending one hour. After adding the foregoing monomer solution, this system was heated at 75° C. for 2 hours, and polymerization was conducted while stirring (the $1^{st}$ step polymerization) to prepare a resin particle dispersion (1H) containing resin particles (1h).

The obtained resin particles (1h) had a weight average molecular weight of 16,500.

(b) $2^{nd}$ Step Polymerization

Into a flask fitted with a stirring device was added a polymerizable monomer solution containing 101.1 weight parts of styrene, 62.2 weight parts of n-butyl acrylate, 12.3 weight parts of methacrylic acid and 1.75 weight parts of n-octyl mercaptan. Subsequently, 93.8 weight parts of paraffin wax "HNP-57" (produced by Nippon Seiro Co., Ltd.) were added into the foregoing polymerizable monomer solution and the mixture was dissolved by heating so that the inner temperature reached 80° C. to prepare a monomer solution.

On the other hand, an aqueous surfactant solution was prepared by dissolving 3 weight parts of the anionic surfactant used in the 1st step polymerization in 1,560 weight parts of ion-exchange water and it was introduced in the flask followed by heating so that the inner temperature reached 80° C. To the aqueous surfactant solution was added 32.8 weight parts (in terms of the solid content conversion) of a dispersion of the foregoing "resin particles (1h)" obtained in the 1st step polymerization. Further, the monomer solution containing paraffin wax was added. After the addition, the aforesaid monomer solution containing paraffin wax was mixed and dispersed for 8 hours by a mechanical dispersion apparatus "CLEAR MIX" (manufactured by M Technique Co.) equipped with a circulation pass to prepare an emulsified particle dispersion which contains emulsified particles (oil droplets) having a dispersion particle diameter of 340 nm.

Next, an initiator solution prepared by dissolving 6 weight parts of potassium persulfate in 200 weight parts of ion-exchange water was added into the foregoing dispersion, and this system was heated at 80° C. for 3 hours while stirring to conduct polymerization (the 2nd step polymerization), and to obtain a resin particle dispersion (1 HM) containing resin particles (1hm).

The obtained resin particles (1hm) had a weight average molecular weight of 23,000.

(3) 3nd Step Polymerization

To the resin particle dispersion (1 HM) obtained in the 2nd step polymerization was added an initiator solution prepared by dissolving 5.45 weight parts of potassium peroxide in 220 weight parts of ion-exchange water. To this mixture was dropped at 80° C. spending one hour a polymerizable monomer solution containing 293.8 weight parts of styrene, 154.1 weight parts of n-butyl acrylate and 7.08 weight parts of n-octyl mercaptan. After termination of dropping the foregoing monomer mixture solution, polymerization (the 3rd step polymerization) was conducted by heating while stirring for 2 hours, and subsequently, the system was cooled to 28° C. to prepare a resin particle dispersion containing "core forming resin particles (1)".

The core forming resin particles (1) thus prepared had a weight average molecular weight of 26,800 and exhibited a glass transition temperature (Tg) of 28.1° C.

A weight average particle diameter of the core forming resin particles (1) in the resin particle dispersion was measured to be 125 nm.

(B) Preparation of "Shell Forming Resin Particles"

"Shell forming resin particles (1)" were prepared in the same manner as the 1st step polymerization, except that the polymerizable monomer solution was replaced with the mixture containing 624 weight parts of styrene, 120 weight parts of n-butyl acrylate, 56 weight parts of methacrylic acid and 16.4 weight parts of n-octyl mercaptan.

The obtained shell forming resin particles (1) had a weight average molecular weight of 16,400 and exhibited a glass transition temperature (Tg) of 62.6° C.

A weight average particle diameter of the shell forming resin particles (1) in the resin particle dispersion was measured to be 95 nm.

(C) Preparation of Yellow Colored Particles (a) Formation of Core Particles

In a reaction vessel fitted with a stirrer, a thermal sensor, a cooling pipe and a nitrogen introducing device were charged with 420.7 weight parts of core forming resin particles (1), 900 weight parts of ion-exchange water and 200 weight parts of yellow colorant particle dispersion (1) and they were stirred. After the inner temperature of the vessel was adjusted to 30° C., an aqueous sodium hydroxide solution having a density of 5 mol/litter was added into this solution to adjust the pH to 10.

Next, an aqueous solution prepared by dissolving 2 weight parts of magnesium chloride hexahydrate in 1,000 parts by weight of ion-exchange water was added to the aforesaid mixture at 30° C. for 10 minutes while stirring. After standing for 3 minutes, elevation of temperature was started, and the temperature of this system was elevated to 65° C. spending 60 minutes. In such state, the particle diameter of associated particles was measured employing "Coulter counter TA-II" (produced by Beckman Coulter Co. Ltd), and when a volume-based median particle diameter $D_{50}$ reached 5.5 μm, the particle diameter increase was terminated via addition of an aqueous solution prepared by dissolving 40.2 weight parts b of sodium chloride in 1,000 weight parts of ion-exchange water. Further, ripening was conducted at a liquid temperature of 70° C. for one hour by heating while stirring to continue the fusion, and then, "core containing liquid (2)" which contains "core particles (2)" was formed.

The circularity of the obtained "core particles (2)" was determined via "FPIA2100" (produced by SYSMEX Co., Ltd.), resulting in an average circularity of 0.912.

(B) Formation of Shell

After adjusting the temperature of the core containing liquid (2) to be 65° C., 96 weight parts of shell forming resin particles (1) were added. Subsequently, an aqueous solution prepared by dissolving 2 weight parts of magnesium chloride hexahydrate in 1,000 weight parts of ion-exchange water was further added for 10 minutes. After the addition, the temperature was increased to 70° C., and stirring was continued spending one hour to fuse the shell forming resin particles (1) on the surface of "core particles (2)". After this, a ripening treatment was conducted at 75° C. for 20 minutes to form a shell layer.

Subsequently, the ripening treatment (shell formation) was stopped by adding 40.2 weight parts of sodium chloride. Then the system was cooled to 30° C. at a rate of 6° C./minute. The resulting particles were filtrated, and they were washed repeatedly with ion-exchanged water at 45° C. Thereafter, drying was conducted employing 45° C. air flow to obtain colored particles having a shell layer formed on the surface of the core particle (hereafter, they are also called as "yellow toner particles (Y-1)").

(3) External Additive Treating Process

To the obtained yellow toner particles (Y-1) was added an external additive composed of 0.6 weight parts of hexamethylsilazane-treated silica (an average primary particle diameter of 12 nm) and 0.8 weight parts of n-octylsilane-treated titanium oxide (an average primary particle diameter of 24 nm). By employing a HENSCHEL MIXER (produced by Mitsui Miike Mining Co., Ltd.), mixing was performed under conditions of a stirring blade peripheral rate of 35 m/second, a processing temperature of 35° C., and a processing period of 15 minutes. Thus, a yellow toner (hereafter, it is also called as "toner (Y-1)") was obtained.

In addition, the shape and the particle size of the obtained "yellow toner particles (Y-1)" were not changed by the addition of the external additive.

Preparation of Yellow Toners 2 and 3

Colorant particle dispersions were prepared in the same manner as preparation of the yellow colorant particle dispersion 1 in Preparation example 1 of Yellow toner, except that used colorants were changed as are listed in Table 1. Yellow colored particles were obtained in the same manner as preparation of the yellow colored particles 1, except that the obtained colorant particle dispersions were used. Further, by carrying out external additive treatment to the obtained colored particles, Yellow toners were obtained (hereafter, they are called as "toners (Y-2) and (Y-3)").

Preparation of Magenta Toner 1

(1) Preparation of Magenta Colorant Particle Dispersion 1

An aqueous surfactant solution was prepared by dissolving 11.5 weight parts of sodium n-dodecylsulfate in 160 weight parts of ion-exchange water with stirring. To the aqueous surfactant solution was gradually added 7 weight parts of a colorant composed of a chelate compound represented by the aforesaid Chemical Formula (4). Then, dispersion treatment was conducted employing a homogenizer "CLEARMIX W MOTION CLM-0.8" (manufactured by M Technique Co.) to prepare a colorant particle dispersion (hereafter, it is called as "magenta colorant particle dispersion (1)") containing colorant particles dispersed therein.

A volume-based median particle diameter of the prepared the magenta colorant particle dispersion (1) was measured to be 626 nm.

(2) Preparation of Magenta Colored Particles 1

(A) Preparation of "Core Forming Resin Particles"

(a) $1^{st}$ Step Polymerization (Formation of Core Particles)

In a 5 L reaction vessel fitted with a stirrer, a thermal sensor, a cooling pipe and a nitrogen introducing device was charged with an aqueous surfactant solution prepared by dissolving 4 weight parts of an anionic surfactant composed of sodium dodecylsulfate in 3,040 weight parts of ion-exchange water. Then, the internal temperature of the system was increased to 80° C. while stirring at a stirring speed of 230 rpm under nitrogen flow. Into the above-described surfactant solution was added an initiator solution prepared by dissolving 10 weight parts of potassium persulfate (KPS) in 400 weight parts of ion-exchange water, and then heated up to 75° C. Then, there was added a polymerizable monomer solution containing 532 weight parts of styrene, 200 weight parts of n-butyl acrylate, 68 weight parts of methacrylic acid and 16.4 weight parts of n-octyl mercaptan into the reaction vessel spending one hour. After adding the foregoing monomer solution, this system was heated at 75° C. for 2 hours, and polymerization was conducted while stirring (the $1^{st}$ step polymerization) to prepare a resin particle dispersion (1H) containing resin particles (1h).

The obtained resin particles (1h) had a weight average molecular weight of 16,500.

(b) $2^{nd}$ Step Polymerization

Into a flask fitted with a stirring device was added a polymerizable monomer solution containing 101.1 weight parts of styrene, 62.2 weight parts of n-butyl acrylate, 12.3 weight parts of methacrylic acid and 1.75 weight parts of n-octyl mercaptan. Subsequently, 93.8 weight parts of paraffin wax "HNP-57" (produced by Nippon Seiro Co., Ltd.) were added into the foregoing polymerizable monomer solution and the mixture was dissolved by heating so that the inner temperature reached 80° C. to prepare a monomer solution.

On the other hand, an aqueous surfactant solution was prepared by dissolving 3 weight parts of the anionic surfactant used in the $1^{st}$ step polymerization in 1,560 weight parts of ion-exchange water and it was introduced in the flask followed by heating so that the inner temperature reached 80° C. To the aqueous surfactant solution was added 32.8 weight parts (in terms of the solid content conversion) of a dispersion of the foregoing "resin particles (1h)" obtained in the $1^{st}$ step polymerization. Further, the monomer solution containing paraffin wax was added. After the addition, the aforesaid monomer solution containing paraffin wax was mixed and dispersed for 8 hours by a mechanical dispersion apparatus "CLEAR MIX" (manufactured by M Technique Co.) equipped with a circulation pass to prepare an emulsified particle dispersion which contains emulsified particles (oil droplets) having a dispersion particle diameter of 340 nm.

Next, an initiator solution prepared by dissolving 6 weight parts of potassium persulfate in 200 weight parts of ion-exchange water was added into the foregoing dispersion, and this system was heated at 80° C. for 3 hours while stirring to conduct polymerization (the $2^{nd}$ step polymerization), and to obtain a resin particle dispersion (1HM) containing resin particles (1hm).

The obtained resin particles (1hm) had a weight average molecular weight of 23,000.

(3) $3^{nd}$ Step Polymerization

To the resin particle dispersion (1HM) obtained in the $2^{nd}$ step polymerization was added an initiator solution prepared by dissolving 5.45 weight parts of potassium peroxide in 220 weight parts of ion-exchange water. To this mixture was dropped at 80° C. spending one hour a polymerizable monomer solution containing 293.8 weight parts of styrene, 154.1 weight parts of n-butyl acrylate and 7.08 weight parts of n-octyl mercaptan. After termination of dropping the foregoing monomer mixture solution, polymerization (the $3^{nd}$ step polymerization) was conducted by heating while stirring for 2 hours, and subsequently, the system was cooled to 28° C. to prepare a resin particle dispersion containing "core forming resin particles (1)".

The core forming resin particles (1) thus prepared had a weight average molecular weight of 26,800 and exhibited a glass transition temperature (Tg) of 28.1° C.

A weight average particle diameter of the core forming resin particles (1) in the resin particle dispersion was measured to be 125 nm.

(B) Preparation of "Shell Forming Resin Particles"

"Shell forming resin particles (1)" were prepared in the same manner as the $1^{st}$ step polymerization, except that the polymerizable monomer solution was replaced with the mixture containing 624 weight parts of styrene, 120 weight parts of n-butyl acrylate, 56 weight parts of methacrylic acid and 16.4 weight parts of n-octyl mercaptan.

The obtained shell forming resin particles (1) had a weight average molecular weight of 16,400 and exhibited a glass transition temperature (Tg) of 62.6° C.

A weight average particle diameter of the shell forming resin particles (1) in the resin particle dispersion was measured to be 95 nm.

(C) Preparation of Magenta Colored Particles (a) Formation of Core Particles

In a reaction vessel fitted with a stirrer, a thermal sensor, a cooling pipe and a nitrogen introducing device were charged with 420.7 weight parts of core forming resin particles (1), 900 weight parts of ion-exchange water and 200 weight parts of magenta colorant particle dispersion (1) and they were stirred. After the inner temperature of the vessel was adjusted to 30° C., 5 an aqueous sodium hydroxide solution having a density of 5 mol/litter was added into this solution to adjust the pH to 10.

Next, an aqueous solution prepared by dissolving 2 weight parts of magnesium chloride hexahydrate in 1,000 parts by weight of ion-exchange water was added to the aforesaid mixture at 30° C. for 10 minutes while stirring. After standing for 3 minutes, elevation of temperature was started, and the temperature of this system was elevated to 65° C. spending 60 minutes. In such state, the particle diameter of associated particles was measured employing "Coulter counter TA-II" (produced by Beckman Coulter Co. Ltd), and when a volume-based median particle diameter $D_{50}$ reached 5.5 μm, the particle diameter increase was terminated via addition of an aqueous solution prepared by dissolving 40.2 weight parts b of sodium chloride in 1,000 weight parts of ion-exchange water. Further, ripening was conducted at a liquid temperature of 70° C. for one hour by heating while stirring to continue the fusion, and then, "core containing liquid (3)" which contains "core particles (3)" was formed.

The circularity of the obtained "core particles (3)" was determined via "FPIA2100" (produced by SYSMEX Co., Ltd.), resulting in an average circularity of 0.912.

(B) Formation of Shell

After adjusting the temperature of the core containing liquid (3) to be 65° C., 96 weight parts of shell forming resin particles (1) were added. Subsequently, an aqueous solution prepared by dissolving 2 weight parts of magnesium chloride hexahydrate in 1,000 weight parts of ion-exchange water was further added for 10 minutes. After the addition, the temperature was increased to 70° C., and stirring was continued spending one hour to fuse the shell forming resin particles (1) on the surface of "core particles (3)". After this, a ripening treatment was conducted at 75° C. for 20 minutes to form a shell layer.

Subsequently, the ripening treatment (shell formation) was stopped by adding 40.2 weight parts of sodium chloride. Then the system was cooled to 30° C. at a rate of 6° C./minute. The resulting particles were filtrated, and they were washed repeatedly with ion-exchanged water at 45° C. Thereafter, drying was conducted employing 45° C. air flow to obtain colored particles having a shell layer formed on the surface of the core particle (hereafter, they are also called as "magenta toner particles (M-1)").

(3) External Additive Treating Process

To the obtained magenta toner particles (M-1) was added an external additive composed of 0.6 weight parts of hexamethylsilazane-treated silica (an average primary particle diameter of 12 nm) and 0.8 weight parts of n-octylsilane-treated titanium oxide (an average primary particle diameter of 24 nm). By employing a HENSCHEL MIXER (produced by Mitsui Miike Mining Co., Ltd.), mixing was performed under conditions of a stirring blade peripheral rate of 35 m/second, a processing temperature of 35° C., and a processing period of 15 minutes. Thus, a magenta toner (hereafter, it is also called as "toner (M-1)") was obtained.

In addition, the shape and the particle size of the obtained "magenta toner particles (M-1)" were not changed by the addition of the external additive.

Preparation of Magenta Toners 2 and 3

Colorant particle dispersions were prepared in the same manner as preparation of the magenta colorant particle dispersion 1 in Preparation example 1 of Magenta toner, except that used colorants were changed as are listed in Table 1. Magenta colored particles were obtained in the same manner as preparation of the magenta colored particles 1, except that the obtained colorant particle dispersions were used. Further, by carrying out external additive treatment to the obtained colored particles, Magenta toners were obtained (hereafter, they are called as "toners (M-2) and (M-3)").

The softening point of the obtained toners each were measured by using Flow Tester CFT-500 (produced by Shimazu Seisakusho Co., Ltd.) with the method described above. The measurement results are shown in Table 1.

Measurement of Maximum Chroma (1) Measurement of Maximum Chroma of Cyan Toner

The maximum chroma of each cyan toner image was measured using a commercially available image forming apparatus "BIZHUB PRO C6500" made by Konica Minolta Business Technologies, Inc. Toner images were formed based on "ECI 2002 image data" and a cyan color gradation evaluation patch on a transfer paper "POD GLOSS COAT" (made by Oji Paper Co. Ltd.) having a weight of 128 g/m$^2$ and a lightness of 93. The relationship between the amount of the toner adhesion on the transfer paper and chroma was determined. And based on the obtained relationship, the chroma at a specific toner adhesion amount or at the chroma at the maximum toner adhesion amount was designated as the maximum chroma. The results are shown in Table 1.

Here, chroma was determined based on the values of a* and b* using the aforesaid Equation (1). The measurement was done using "GRETAG MACBETH SPECTROLINO" (produced by Gretag Macbeth Co., Ltd.) with the following conditions: a D65 light source as a light source, a reflection measuring aperture diameter of 4 mm, 10 nm intervals in the wavelength range of 380 to 730 nm, a viewing angle (observer) of 2°, an exclusive white tile for adjustment of the base line and at a hue angle h of 195 degree.

(2) Measurement of Maximum Chroma of Yellow Toner

The maximum chroma of each yellow toner image was determined in the same manner as done for the aforesaid cyan toners, except that the cyan color gradation evaluation patch was replaced with a yellow color gradation evaluation patch and that the condition of the hue angle h was changed from 195 degree to 75 degree. The results are shown in Table 1.

(3) Measurement of Maximum Chroma of Magenta Toner

The maximum chroma of each magenta toner image was determined in the same manner as done for the aforesaid cyan toners, except that the cyan color gradation evaluation patch was replaced with a magenta color gradation evaluation patch and that the condition of the hue angle h was changed from 195 degree to 315 degree. The results are shown in Table 1.

Measurement of Lightness

The measurement of lightness was done using "GRETAG MACBETH SPECTROLINO" (produced by Gretag Macbeth Co., Ltd.) with the following conditions: a D65 light source as a light source, a reflection measuring aperture diameter of 4 mm, 10 nm intervals in the wavelength range of 380 to 730 nm, a viewing angle (observer) of 2°, and an exclusive white tile for adjustment of the base line was used. The results are shown in Table 1.

Evaluation of Gradation

The gradation steps in the aforesaid gradation evaluation patch of each color were visually observed and the image was ranked as:

A: all of the gradation steps can be recognized

B: not able to be recognized between the solid image patch and the high density patch adjacent to the solid image patch, but other gradation steps can be recognized C: not belonging to the aforesaid "A" or "B".

TABLE 1

| Toner | Colorant Kind | | Weight | Added amount (weight | | | Softening point | |
|---|---|---|---|---|---|---|---|---|
| No. | a | b | ratio (a/b) | parts) | Chroma | Lightness | (° C.) | Gradation |
| CA-1 | CuPc | — | 100/0 | 5 | 57 | 48 | 113 | A |
| CA-2 | CuPc | — | 100/0 | 2 | 50 | 52 | 94 | B |
| CA-3 | CuPc | SiPc | 90/10 | 5 | 58 | 49 | 80 | B |
| CA-4 | CuPc | SiPc | 80/20 | 5 | 58 | 50 | 112 | B |
| CA-5 | CuPc | CuPc dye | 90/10 | 5 | 57 | 49 | 95 | A |
| CA-6 | CuPc | CuPc dye | 80/20 | 5 | 58 | 49 | 79 | B |
| CB-1 | — | SiPc | 0/100 | 5 | 63 | 64 | 112 | A |
| CB-2 | — | SiPc | 0/100 | 2 | 53 | 74 | 93 | A |
| CB-3 | — | CuPc dye | 0/100 | 5 | 59 | 61 | 77 | B |
| CB-4 | — | CuPc dye | 0/100 | 2 | 51 | 68 | 111 | A |
| CB-5 | CuPc | SiPc | 10/90 | 5 | 52 | 60 | 93 | B |
| CB-6 | CuPc | CuPc dye | 10/90 | 5 | 58 | 58 | 78 | B |
| Y-1 | PY65 | PY36 | 95/5 | 5 | 89 | 73 | 112 | A |
| Y-2 | PY74 | PY139 | 90/10 | 5 | 104 | 88 | 94 | A |
| Y-3 | PY74 | PY36 | 80/20 | 5 | 101 | 82 | 79 | A |
| M-1 | Chelate | | — | — | 84 | 50 | 114 | A |
| M-2 | Rhodamine dye | | — | 7 | 78 | 53 | 95 | A |
| M-3 | Rhodamine pigment | | — | 7 | 74 | 46 | 80 | A |
| C-1 | CuPc | — | 100/0 | 0.5 | 39 | 63 | 98 | C |
| C-2 | CuPc | SiPc | 50/50 | 5 | 60 | 34 | 121 | C |
| C-3 | CuPc | CuPc dye | 50/50 | 5 | 58 | 31 | 73 | C |

In Table 1, the abbreviations indicate as follows:
"CuPc" indicates C.I. Pigment Blue 15:3,
"SiPc" indicates a compound of Chemical Formula (2),
"CuPc dye" indicates C.I. Solvent Blue 70,
"Chelate" indicates a compound of Chemical Formula (4),
"Rhodamine dye" indicates C.I. Solvent Red 49,
"Rhodamine pigment" indicates C.I. Pigment Red 81:4,
"PY65" indicates C.I. Pigment Yellow 65,
"PY74" indicates C.I. Pigment Yellow 74,
"PY36" indicates C.I. Pigment Yellow 36, and
"PY139" indicates C.I. Pigment Yellow 139.

Preparation of Developers 1 to 18, and Preparation of Comparative Developers 1 to 3

To toners (CA-1) to (M-3) and comparative toners (C-1) to (C-3) each were added a ferrite carrier covered with a silicone resin on the surface thereof and having a volume average particle diameter of 60 μm in such a manner that a content of each toner is 6 weight %. Thus Developers (CA-1) to (M-3) and Comparative developers 1 to 3 were prepared.

Examples of 1 to 11, and Comparative Examples of 1 to 3

The following evaluations were performed by forming images using the prepared Developers (CA-1) to (M-3) and Comparative developers 1 to 3 as combined shown in the following Table 2.

Evaluation of Color Reproduction

Among the logo marks appeared in home pages in the Internet, each arbitrary selected 50 pieces of pale-bluish logo mark (light blue logo mark), bluish logo mark (dark blue logo mark), and greenish logo mark were displayed on the display of a computer. The Developers shown in Table 2 were applied to each of the four developing devices in the image forming apparatus shown in FIG. 1, and the logo marks were printed on the transfer paper "Japanese paper copy Daio" (made by Ozu Corp.). Comparison of the logo marks printed on this transfer paper with the logo marks displayed on the display was made by 100 panelists of the ages of 10's to 70's to cheek whether the color of the logo mark is reproduced without giving a sense of discomfort on a transfer paper. The evaluation was made according to the following criteria.

A: 90 or more panelists admit that the logo marks are faithfully reproduced

B: from 80 to less than 90 panelists admit that the logo marks are faithfully reproduced C: from 60 to less than 80 panelists admit that the logo marks are faithfully reproduced D: less than 60 panelists admit that the logo marks are faithfully reproduced.

The evaluation results are shown in Table 2.

The computer system used for the evaluation of color reproductivity was as follows:

"iMac" (made by Apple Computer Co., Ltd.)

24 inch wide screen LCD

Resolution: 1920×1200 pixels 2.16 GHz Intel Core 2 Duo Processor 1
4 MB Common L2 Cache
1 GB Memory (2×512 MB SO-DIMM)
250 GB Serial ATA Hard drive 2
8× Double Layer SuperDrive (DVD+R DL, DVD±RW, CD-RW)
NVIDIA GeForce 7300 GT 128 MB GDDR 3 Memories
AirMAc Extreme and Bluetooth 2.0 built-in
Apple Remote.

Evaluation of Color Reproductivity

(1) Evaluation of Color Reproductivity of Greenish Color Codes

On the display of the computer used in the above-mentioned color reproductivity evaluation, the patch picture images of the following 8 kinds of greenish color codes were outputted. By using the image forming apparatus shown in FIG. 1, the Developers shown in Table 2 were applied to each of the four developing devices of this image forming apparatus, and the images were printed on the transfer paper "Japanese paper copy Daio" (made by Ozu Corp.). The image tone printed on this transfer paper was checked visually, and the evaluation was performed as follows:

A (very good): all of the 8 picture images were distinguished;

B (good): from 6 to less than 8 picture images were distinguished;

C (not good): less than 6 picture images were distinguished.

The evaluation results are shown in Table 2.

Here, the 8 green color codes used for evaluation are as follows: Yellow Green (#9ACD32), Green Yellow (#ADFF2F), Chartreuse (#7FFF00), Lime (#00FF00), Spring Green (#00FF7F), Medium Spring Green (#00FA9A), Lime Green (#32CD32), and Medium Sea Green (#3CB371).

(2) Evaluation of Color Reproductivity of Dark Blue-Purplish Color Codes

On the display of the computer used in the above-mentioned color reproductivity evaluation, the patch picture images of the following 7 kinds of blue-purplish color codes were outputted. By using the image forming apparatus shown in FIG. 1, the Developers shown in Table 2 were applied to each of the four developing devices of this image forming apparatus, and the images were printed on the transfer paper "Japanese paper copy Daio" (made by Ozu Corp.). The image tone printed on this transfer paper was checked visually, and the evaluation was performed as follows:

A (very good): all of the 7 picture images were distinguished;

B (good): from 5 to less than 7 picture images were distinguished;

C (not good): less than 5 picture images were distinguished.

The evaluation results are shown in Table 2.

Here, the 7 blue-purple color codes used for evaluation are as follows: #7f00ff, #7700ef, #7000e0, #6800d1, #6000c1, #5900b2, and #5100a3.

Evaluation of Image Quality: Evaluation of Granularity and Homogeneity

By using the image forming apparatus shown in FIG. 1, the Developers shown in Table 2 were applied to each of the four developing devices of this image forming apparatus, the images of Sample No. 5-1 of Test Chart No. 3 made by The Imaging Society of Japan Image were printed on the transfer paper "Japanese paper copy Daio" (made by Ozu Corp.). Sample No. 5-1 contains a color portrait having a continuous tone and a color gradation patch. The image tone printed on this transfer paper was checked with naked eyes and also with a 20 power loupe. The image evaluation was performed as follows:

A: granular structure is not detected when the image is carefully observed with naked eyes, and no toner particles which may become a dust are observed between dots with a 20 power loupe B: granular structure is slightly detected when the image is carefully observed with naked eyes, and from 1 to 3 toner particles which may become a dust are observed between dots with a 20 power loupe C: roughness feeling is given by the image which is evaluated as "B" when the image is observed with naked eyes, or there are observed uncountable number of toner particles which may become a dust between dots with a 20 power loupe The evaluation results are shown in Table 2.

Evaluation of Gradation

The gradation steps of the color gradation patch on the print image produced as described above were observed with naked eyes, and image evaluation was performed as follows:

A: all of the gradation steps can be recognized

B: cannot be recognized between the solid image patch and the high density patch adjacent to the solid image patch, but other gradation steps can be recognized C: not belonging to the aforesaid "A" or "B".

The evaluation results are shown in Table 2.

TABLE 2

| | Toner (Developing agent) | | | | | Evaluation result | | | | | | |
|---|---|---|---|---|---|---|---|---|---|---|---|---|
| | Cyan | | | | | Color reproductivity | | | Tone Reproductivity | | | |
| | Low lightness (1) | High lightness (2) | Yellow | Magenta | Difference of softening points | Pale-blue | Blue | Green | Greenish tone | Dark tone | Image quality | Gradation |
| Example 1 | CA-1 | CB-1 | Y-1 | M-1 | 2° C. | A | A | A | A | A | A | A |
| Example 2 | CA-1 | CB-2 | Y-2 | M-2 | 20° C. | B | A | B | A | A | B | A |
| Example 3 | CA-1 | CB-3 | Y-3 | M-3 | 36° C. | B | B | A | B | A | B | B |
| Example 4 | CA-1 | CB-4 | Y-1 | M-1 | 3° C. | A | A | A | A | A | A | A |
| Example 5 | CA-1 | CB-5 | Y-2 | M-2 | 20° C. | A | B | A | B | A | B | A |
| Example 6 | CA-1 | CB-6 | Y-3 | M-3 | 35° C. | B | A | A | B | A | B | A |
| Example 7 | CA-2 | CB-1 | Y-1 | M-1 | 20° C. | B | B | B | A | A | B | B |

TABLE 2-continued

| | Toner (Developing agent) | | | | | Evaluation result | | | | | | |
|---|---|---|---|---|---|---|---|---|---|---|---|---|
| | Cyan | | | | | Color reproductivity | | | Tone Reproductivity | | | |
| | Low lightness (1) | High lightness (2) | Yellow | Magenta | Difference of softening points | Pale-blue | Blue | Green | Greenish tone | Dark tone | Image quality | Gradation |
| Example 8 | CA-3 | CB-1 | Y-2 | M-2 | 32° C. | A | A | B | A | A | B | A |
| Example 9 | CA-4 | CB-1 | Y-3 | M-3 | 33° C. | B | B | A | A | B | B | B |
| Example 10 | CA-5 | CB-1 | Y-1 | M-1 | 19° C. | A | A | B | A | A | B | A |
| Example 11 | CA-6 | CB-1 | Y-2 | M-2 | 18° C. | A | B | B | A | B | B | B |
| Comparative example 1 | C-1 | C-2 | Y-1 | M-1 | 16° C. | C | B | C | B | C | C | C |
| Comparative example 2 | C-2 | C-3 | Y-2 | M-2 | 48° C. | B | C | C | C | C | C | C |
| Comparative example 3 | C-3 | C-1 | Y-3 | M-3 | 25° C. | B | C | B | C | C | C | C |

As are shown in Table 2, "Examples 1 to 11" which used two cyan toners which satisfy the compositions of the present invention each were confirmed to produce good color reproductivity. In particular, good results were obtained for the color reproductivity of green or dark blue-violet image. Moreover, there were obtained good gradation results. It was confirmed that, by making the difference between the maximum and the minimum softening point of the four toners which constitute the developer used for image formation in Examples 1 and 4 to be less than 4° C., there were produced good natural picture images which does not have uneven gloss and does not show subtle swelling portion caused by toners.

DESCRIPTION OF SYMBOLS

10: Image forming apparatus
11: Image reading section
12: Printer section
21: Image reading unit
22: Paper feed cassette
23: Paper feed roller
25: Paper discharge roller
26: Image support transport belt
26A, 26B: Support rollers
27: Paper discharge tray
29: Fixing apparatus
30 (30Y, 301C, 302C, 30M, 30K): Image forming units
31Y: Photoreceptor
32Y: Charging device
33: Exposure apparatus
34Y: Developing apparatus
37Y: Transfer device
38Y: Cleaning device

The invention claimed is:

1. A method for forming a full color image using at least a yellow toner, a magenta toner, a cyan toner (1) and a cyan toner (2), the method comprising the steps of:

(a) forming a toner image by developing an electrostatic latent image formed on an electrostatic latent image carrier by employing a developer, (b) transferring the toner image formed on the electrostatic latent image carrier onto an image support, and (c) fixing the toner image transferred onto the image support, wherein a toner image formed by using solely the cyan toner (1) exhibits: a maximum chroma C* of 50 or more; and a lightness L* of 30 to 52 in a color space represented by L*a*b* colorimetric system, a toner image formed by using solely the cyan toner (2) exhibits: a maximum chroma C* of 50 or more; and a lightness L* of 58 to 75 in a color space represented by L*a*b* colorimetric system; and the cyan toner (2) contains a colorant represented by Formula (I):

Formula (I)

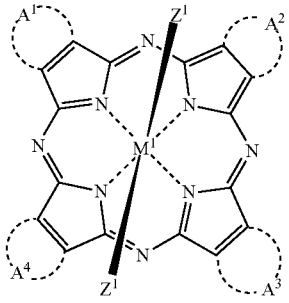

wherein $M^1$ represents a silicon atom, and $Z^1$ represents Formula (II):

Formula (II)

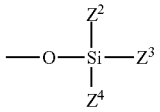

wherein $Z^2$ to $Z^4$ each independently represents an alkyl group of 1 to 22 carbon atoms; and aryloxy group of 6 to 18 carbon atoms; or an alkoxy group of 1 to 22 carbon atoms, and $A^1$ to $A^4$ each independently represents a group of atoms which forms a benzene ring.

2. The method for forming a full color image of claim 1, wherein a toner image formed by using solely the yellow toner exhibits: a maximum chrome C* of 85 or more; and a lightness L* of 70 to 90 in a color space represented by L*a*b* colorimetric system; and a toner image formed by using solely the magenta toner exhibits: a maximum chroma C* of 70 or more; and a lightness L* of 20 to 55 in a color space represented L*a*b* colorimetric system.

3. The method for forming a full color image of claim 1, wherein the yellow toner, the magenta toner, the cyan toner (1) and the cyan toner (2) each exhibit a softening point of 75 to 115° C.; and a difference of the highest softening point and the lowest softening point among the aforesaid four toners is in the range of less than 4° C.

4. The method for forming a full color image of claim 2, wherein the yellow toner, the magenta toner, the cyan toner (1) and the cyan toner (2) each exhibit a softening point of 75 to 115° C.; and a difference of the highest softening point and the lowest softening point among the aforesaid four toners is in the range of less than 4° C.

* * * * *